US006070292A

United States Patent [19]

Langelaan

[11] Patent Number: 6,070,292

[45] Date of Patent: Jun. 6, 2000

[54] SCRAPING TOOL

[76] Inventor: Martin John Langelaan, St Peters Quay, Totnes, Devon, United Kingdom, TQ9 5EW

[21] Appl. No.: 09/187,395

[22] Filed: Nov. 6, 1998

[30] Foreign Application Priority Data

Nov. 15, 1997 [GB] United Kingdom ..... 9724051

[51] Int. Cl.[7] ..... A47L 9/06

[52] U.S. Cl. ..... 15/401; 15/410

[58] Field of Search ..... 15/401, 402, 410

[56] References Cited

U.S. PATENT DOCUMENTS

| | | | |
|---|---|---|---|
| 1,446,854 | 2/1923 | Marshall | 15/401 |
| 2,793,384 | 5/1957 | Ortega | 15/401 X |
| 2,879,530 | 3/1959 | Ego | 15/401 X |
| 4,947,515 | 8/1990 | Ivarsson | 15/401 |
| 5,184,372 | 2/1993 | Mache | 15/401 |
| 5,575,035 | 11/1996 | Reis et al. | 15/401 X |

FOREIGN PATENT DOCUMENTS

| | | | |
|---|---|---|---|
| 144520 | 3/1962 | U.S.S.R. | 15/401 |

*Primary Examiner*—Chris K. Moore
*Attorney, Agent, or Firm*—Ira S. Dorman

[57] ABSTRACT

A handle 2 has an integral connector 7 for connection with a suction hose and hand-grip ribs 13–16. A head 6 projects below the handle 7 with a transverse slot-shaped bottom opening, and a blade 22 extends along the front margin of the opening with a scraping edge projecting below the opening. An upstanding projection at the junction between the head 6 and the handle 2 has a front face which slopes forwardly and downwardly to the blade 22 for applying manual pressure to the scraping head.

13 Claims, 3 Drawing Sheets

SCRAPING TOOL

TECHNICAL FIELD OF THE INVENTION

This invention relates to hand tools, and more particularly, a hand-held scraping tool.

BACKGROUND

By way of example, boat hulls are protected with toxic anti-fouling paint to reduce the buildup of marine organisms. In order to ensure continued protection it is necessary periodically to remove the paint and any adhering matter and apply a fresh layer. The removal of such material is generally achieved using a hand-held scraping tool.

Scraping tools are also used in a range of other applications where a layer of material is to be removed, often being unpleasant or toxic in nature.

The present invention seeks to provide a new and inventive form of scraping tool.

SUMMARY OF THE INVENTION

The present invention proposes a hand-held scraping tool comprising:

an elongate handle;

a connector for connection with a suction pipe;

a head including at least one suction opening in communication with said connector and which, in use, is moved over a surface to be scraped; and a blade mounted on said head and having a scraping edge which extends transverse to said handle.

More particularly, the invention provides a hand-held scraping tool comprising:

an elongate handle having a bottom region and front and rear ends, said handle containing an internal passage;

a connector at said rear end of said handle for connecting said passage with a suction pipe;

a head formed at said front end of said handle, said head projecting below said bottom region and including a slot-shaped opening which, in use, is moved over a surface to be scraped, said opening extending transverse to said handle on a plane which is substantially parallel to said bottom region, and said opening being in communication with said passage via said head;

a hard metal blade mounted on said head to extend along an edge of said opening which is remote from said handle, said blade being disposed on a plane which is generally normal to said plane of said opening and having a sharp scraping edge which extends below said opening.

The tool is used for scraping a surface by pulling the blade over the surface in a rearward direction, which allows considerable manual force to be applied to the surface being scraped. By connecting the handle to a vacuum source, e.g. via a flexible hose, material freed from the surface is removed from the immediate area of the scraping blade, which results in a more efficient and clean scraping operation.

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

Figure 1:
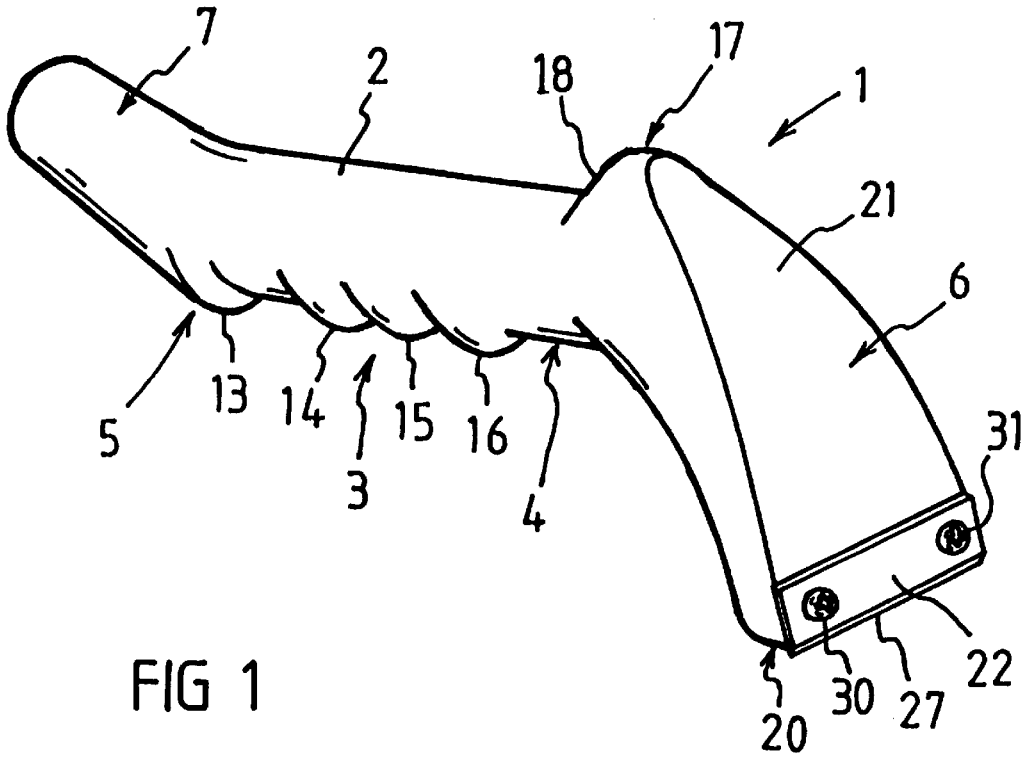
FIG. 1 is a general view of a scraping tool in accordance with the invention.
Figure 2:
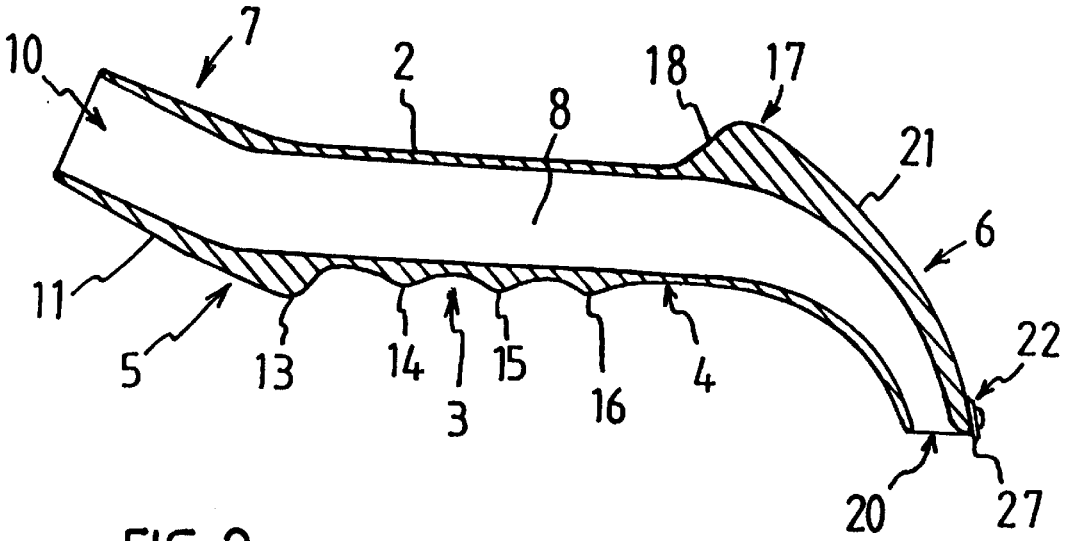
FIG. 2 is a longitudinal section through the tool.

Referring to FIGS. 1 and 2, the scraping tool includes a main component 1 which is integrally cast or moulded of a strong but lightweight material such as a plastics or alloy. The component 1 includes an elongate tubular and generally cylindrical handle 2 having a bottom region 3 and front and rear ends 4 and 5 respectively, a head 6 being formed at the front end of the handle 2 and a connector 7 being formed at the rear end of the handle. As can be seen in FIG. 2, the component 1 is hollow and contains an internal cavity 8 forming a passage which extends continuously through the head 6, the handle 2 and the connector 7.

The connector 7 shown in the drawings is male, being generally cylindrical and open at its rear end 10 with an upward inclination away from the handle 2. The external surface 11 of the connector 7 is slightly tapered for wedging connection with the female end of a vacuum pipe or hose (not shown). It will be appreciated however that other forms of connector could be used. For example, the connector could be female with a tapered internal surface, or the connector could have an internal or external screw thread for connection with the vacuum hose. The illustrated connector could also be coupled with other kinds of vacuum hose fitting via a suitable adaptor. For example, a short cylindrical sleeve can be used to connect the tool with a male vacuum hose fitting.

It will be noted that the lower surface of the connector 7 extends downwardly to form a smooth transversely extending rib 13. In addition, the bottom region 3 of the handle 2 is formed with three further transversely extending ribs 14, 15 and 16 which are smoothly curved to fit comfortably between the fingers and provide an enhanced grip when the handle 2 is held in the hand. In addition, the upper region of the handle 2 has an upstanding projection 17, located proximate the junction between the handle 2 and the head 6, forwardly of the foremost rib 16. The surface of the projection 17 is smoothly curved, its rear surface 18 being generally upwardly inclined in a forward direction.

The front end 4 of the handle 3 leads smoothly into the head 6 which curves downwardly to project below the bottom wall 3 and at the same time progressively becomes narrower in a front-rear direction whilst opening out transversely to terminate in a rectangular slot-shaped opening 20, best seen in FIG. 3. The opening 20 extends transverse to the handle and, as seen in FIG. 2, the opening lies on a plane which is generally parallel to the bottom region 3 of the handle 2. It will further be noted in FIG. 2 that the opening 20 is in communication with the internal cavity 8 via the head 6.

Figure 4:
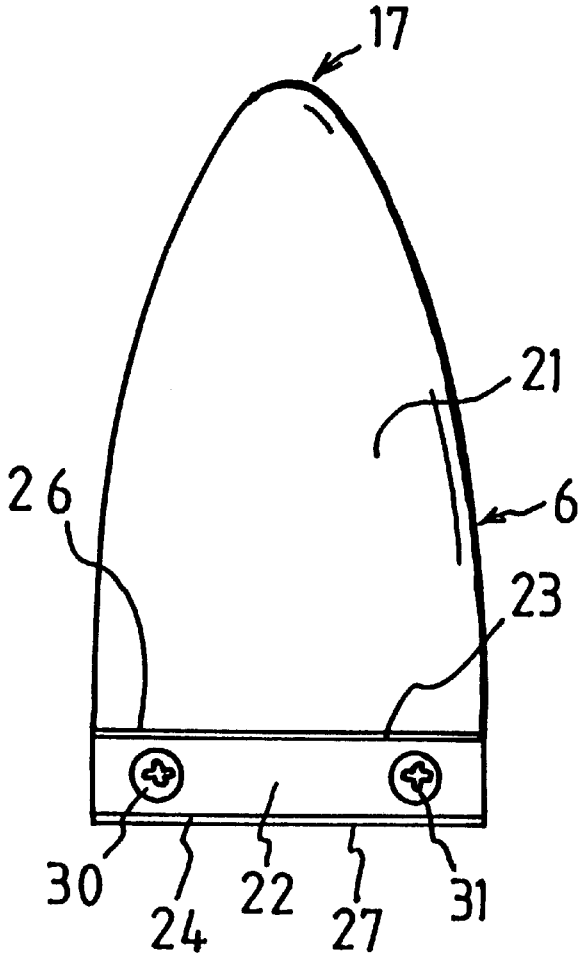
FIG. 4 is front elevation of the tool.

As can be seen in FIG. 4, the front surface 21 of the head 6 has a generally triangular shape and is contiguous with the front surface of the projection 17, sloping smoothly forwardly and downwardly towards the opening 20 (FIGS. 1 and 2).

Figure 3:
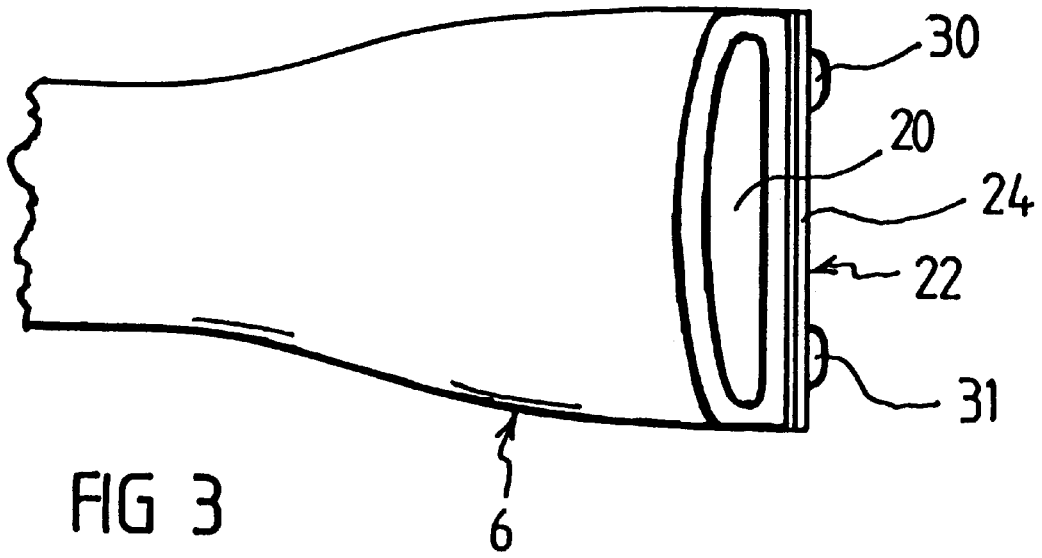
FIG. 3 is a bottom view of the front portion of the tool.
Figure 5:
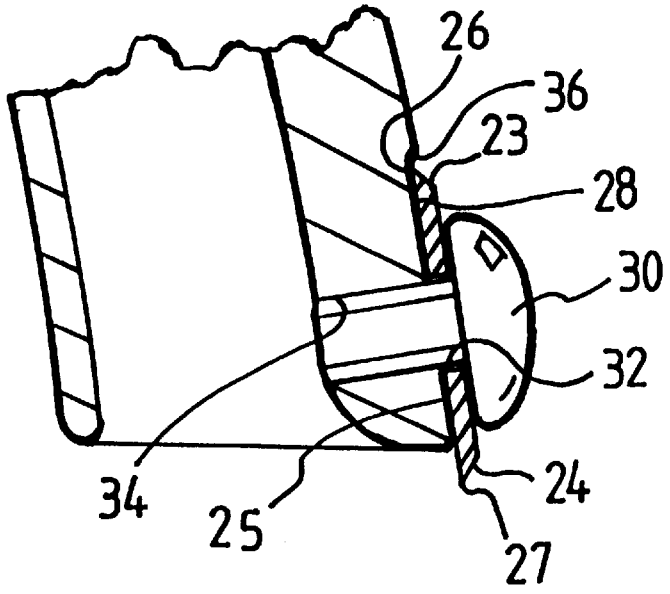
FIG. 5 is a detailed section through the front end of the tool.

Referring to FIGS. 3, 4 and 5, a hard metal blade 22 is secured to the outside of the head 6 to extend along the front longitudinal margin of opening 20. The blade may be formed of tungsten carbide or high speed steel for example and is of generally rectangular shape with the opposed longitudinal edges 23 and 24 of the blade being ground at an angle to the rear surface 25 to form sharp scraping edges 26 and 27. The rear surface of the blade 22 is seated against a flat and slightly recessed blade-support area 28 such that the blade is disposed generally perpendicular to the plane of the opening 20, or at a very steep angle thereto. In addition it can be seen that the lower scraping edge 27 projects below the plane of the opening 20 extending generally parallel thereto. The blade 22 is secured to the head 6 by screws 30 and 31 which pass through non-threaded apertures 32 in the blade 22 to be received in screw-threaded apertures 34 in the head 6. It will be appreciated that the uppermost scraping edge 26 is protected by shoulder 36 formed at the flank of the recessed area 28. However, when the lower edge 27 becomes blunt the screws 30 and 31 can be removed to allow the blade to be rotated and re-secured with the unused sharp edge lowermost.

Figure 6:
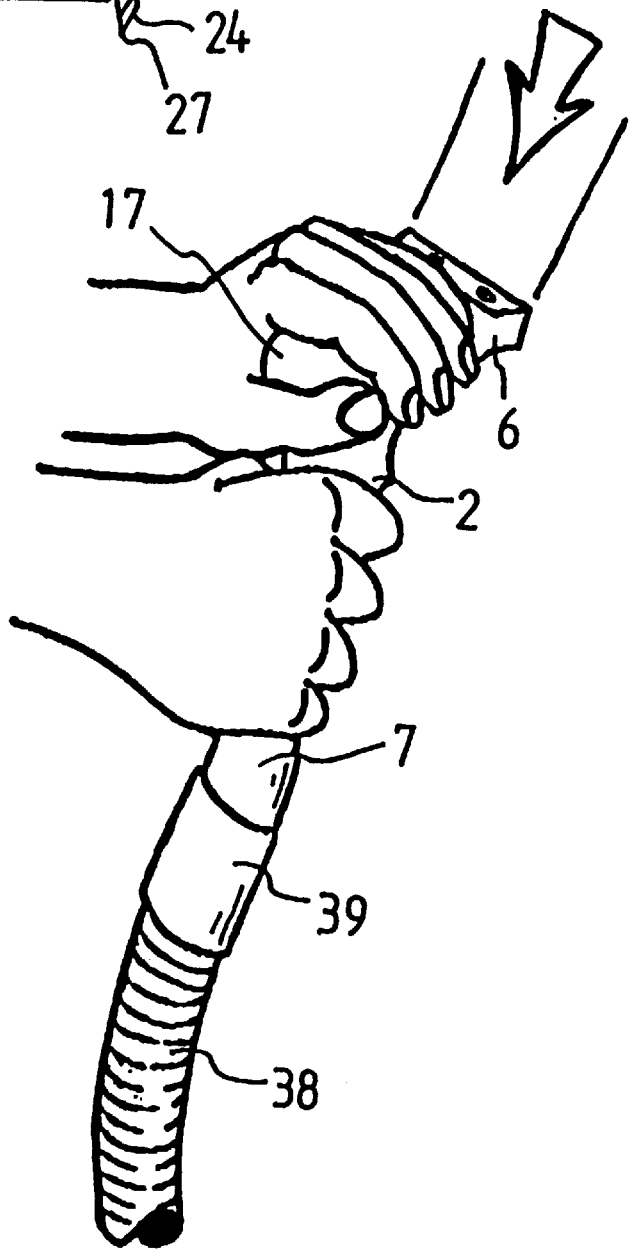
FIG. 6 is a general view of the tool, in use.

Referring now to FIG. 6, when the tool is used for scraping a surface a vacuum hose 38 leading from suction apparatus (not shown) is coupled to the connector 7, e.g. by means of a short length of elastomeric tube 39 which forms a double-female coupler to connect with a male hose fitting. The hose 38 applies suction to the opening 20 via the internal cavity 8. The handle 2 is held in one hand with the fingers located between the ribs 13–16 whilst the other hand is placed on the surface 21 to apply rearward pressure thereto, with the thumb being placed behind the projection 17. The opening 20 is moved over a surface to be scraped pulling the blade 22 over the surface in a rearward direction, as indicated by the arrow, at the same time applying pressure to the head via the surface 21.

From the foregoing it will be seen that the design of the tool allows considerable manual force to be applied to the surface being scraped. At the same time, material freed from the surface is removed from the immediate area of the blade 22 so that the action of the blade is not impeded by a buildup of debris and the scraped area is not obscured.

When both of the scraping edges 26 and 27 become blunt the blade 22 can be replaced by removing the screws 30 and 31.

Whilst the illustrated tool is particularly suitable for removing toxic material from boat hulls it could be used in other applications, e.g. to remove lead-containing paint from a surface.

It will be appreciated that the features disclosed herein may be present in any feasible combination. Whilst the above description lays emphasis on those areas which, in combination, are believed to be new, protection is claimed for any inventive combination of the features disclosed herein.

What I claim is:

1. A hand-held scraping tool comprising:

a rigid moulding which includes:

an elongate handle extending generally on a first axis and having a bottom region and front and rear ends, said handle containing an internal passage;

a connector at said rear end of said handle for connecting said passage with a suction pipe; and a head formed at said front end of said handle, said head being flattened and diverging downwardly from said first axis to project below said bottom region and terminating in a bottom-most surface defining a downwardly directed slot-shaped suction opening extending transverse to said first axis, said tool being constructed for movement, in use, in a rearward direction over a surface to be scraped with said bottom-most surface of said head in close proximity to the surface to be scraped, said head having a front-most surface which slopes downwardly in a forward direction to meet said bottom-most surface, and said opening being in communication with said passage via said head; and a hard metal scraping blade mounted on said front-most surface of said head to extend along a front edge of said bottom-most surface remote from said handle, and having a sharp scraping edge which projects below said bottom-most surface.

2. A scraping tool according to claim 1, in which said at least one opening lies on a plane which is substantially parallel with said bottom region.

3. A scraping tool according to claim 1, in which said blade is disposed on a plane which is substantially perpendicular to said slot-shaped opening.

4. A scraping tool according to claim 1, in which said handle is formed with an integral hand grip.

5. A scraping tool according to claim 4, in which said hand grip comprises a plurality of transverse ribs formed on said bottom region of said handle.

6. A scraping tool according to claim 5, in which there are at least three such ribs.

7. A scraping tool according to claim 1, in which said rigid moulding is cast from a self-setting polymeric material.

8. A scraping tool according to claim 1, in which said blade is releasably secured to said head.

9. A scraping tool according to claim 8, in which said blade is secured by screws received in threaded apertures in said head.

10. A hand-held scraping tool comprising:

a handle;

a connector for connection with a suction pipe;

a head including at least one suction opening in communication with said connector and which, in use, is moved over a surface to be scraped; and a scraping blade mounted on said head, said tool having an upstanding projection between said head and said handle, said upstanding projection having a front face which slopes smoothly downwards in a forward direction to said blade.

11. A hand-held scraping tool comprising:

a handle;

a connector, upwardly inclined away from said handle, for connection with a suction pipe;

a head including at least one suction opening in communication with said connector and which, in use, is moved over a surface to be scraped; and a scraping blade mounted on said head.

12. A scraping tool according to claim 11, in which said connector is male.

13. A scraping tool according to claim 11, in which said blade extends transverse to said handle.

* * * * *